United States Patent [19]

Martin

[11] Patent Number: 4,588,222

[45] Date of Patent: May 13, 1986

[54] ROCKET EXTRACTION DEVICE

[75] Inventor: Donald L. Martin, Maurertown, Va.

[73] Assignee: The United States of America as represented by the Secretary of the Army, Washington, D.C.

[21] Appl. No.: 640,629

[22] Filed: Aug. 14, 1984

[51] Int. Cl.[4] ..... B66C 1/30

[52] U.S. Cl. ..... 294/16; 294/106

[58] Field of Search ..... 294/16, 106, 113, 117, 294/118, 119, 28, 62, 86.4, 67.3, 67.31, 67.32, 87.22, 87.24, 115, 104, 29, 34, 15

[56] References Cited

U.S. PATENT DOCUMENTS

| | | | |
|---|---|---|---|
| 2,930,648 | 3/1960 | Allan | 294/106 |
| 2,997,326 | 8/1961 | Daum | 294/16 |
| 3,126,222 | 3/1964 | Stuart | 294/16 |

*Primary Examiner*—James B. Marbert

*Attorney, Agent, or Firm*—John E. Becker; Anthony T. Lane; Robert P. Gibson

[57] ABSTRACT

A hand-held and hand-operated gripping device for extracting live rockets from rocket launch tubes is disclosed. The device has the ability to engage and grip an extraction bar extending across the exhaust end of a rocket motor and extract the rocket from the launch tube by a straight pulling action along the axis of the rocket. Jaws of the rocket extracting device are pivotally held on a frame member and are resiliently biased open. The jaws are closed by movement of a separate elongated finger grip bar toward a parallel bar of the frame member while the finger grip bar is in engagement with convergent cam faces of the pivoted jaws. The finger grip bar is captively held in free-floating relationship to the jaws and frame member.

14 Claims, 10 Drawing Figures

FIG.1
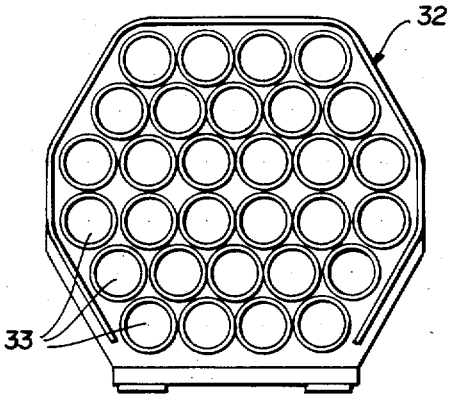
FIG.2
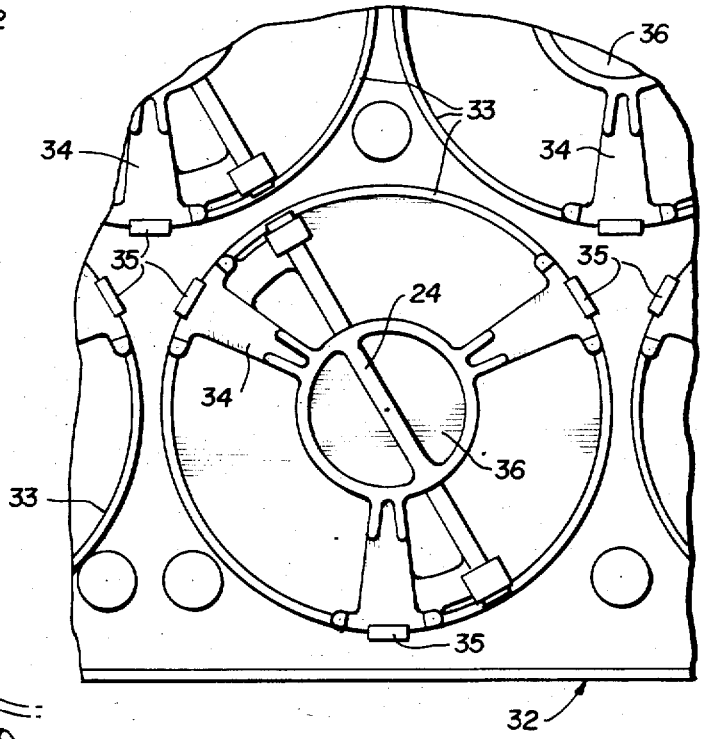
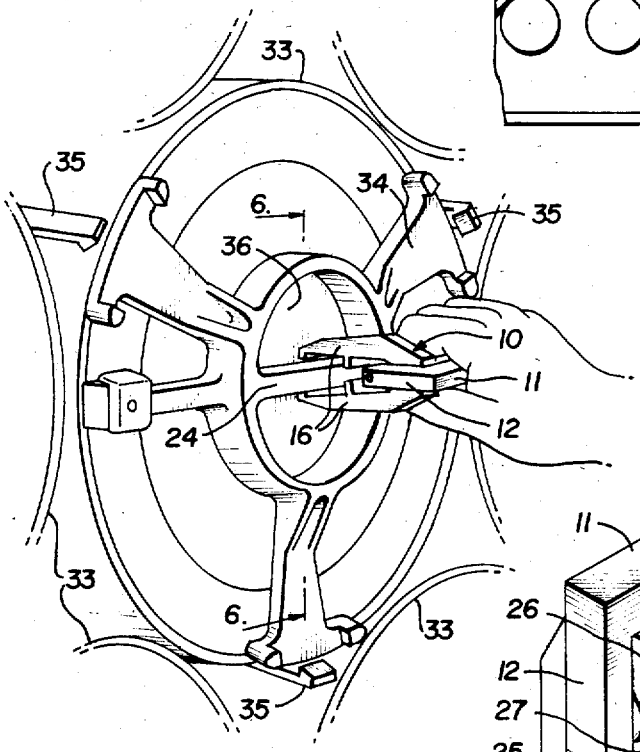
FIG.3
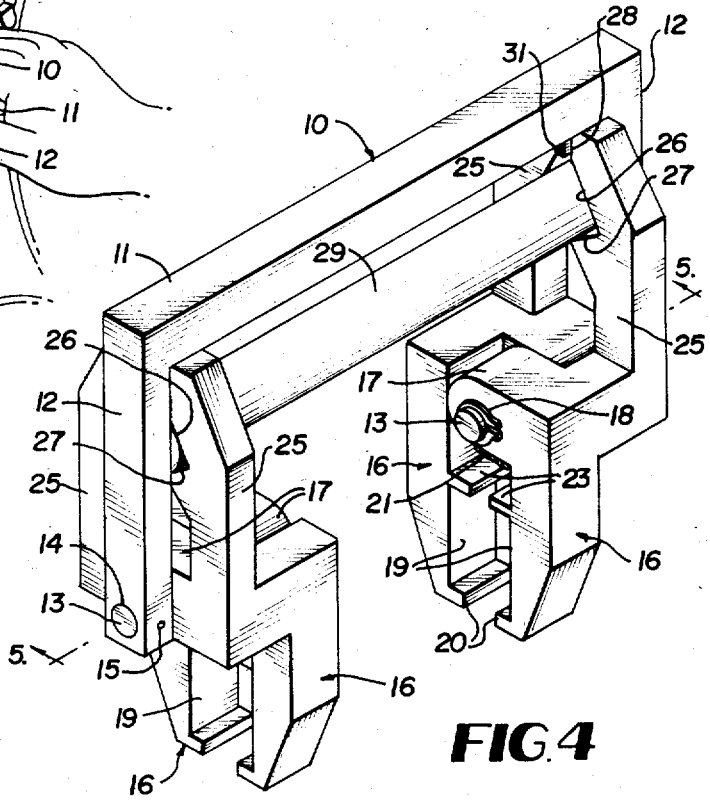
FIG.4

FIG.8
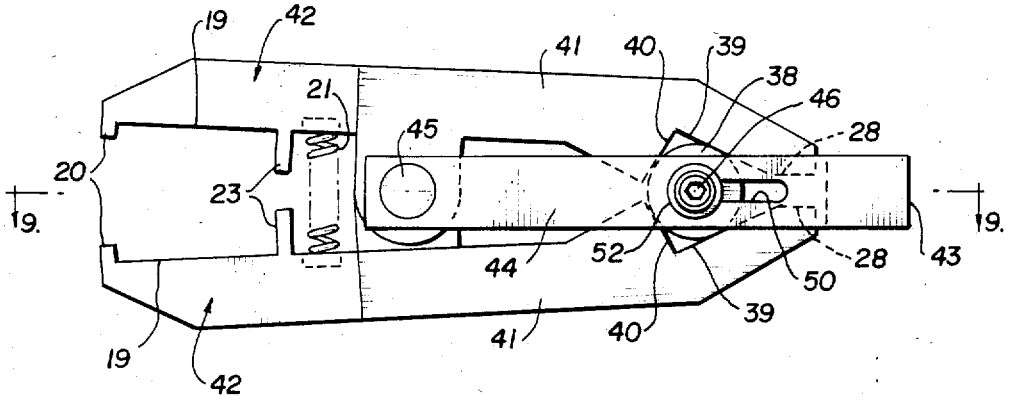
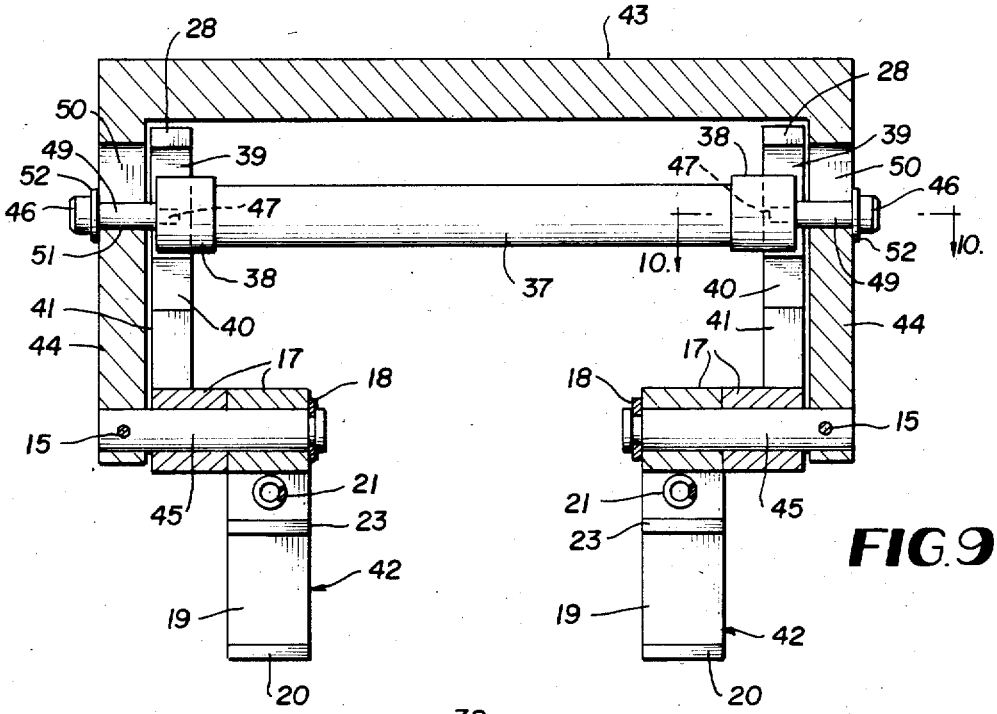
FIG.9
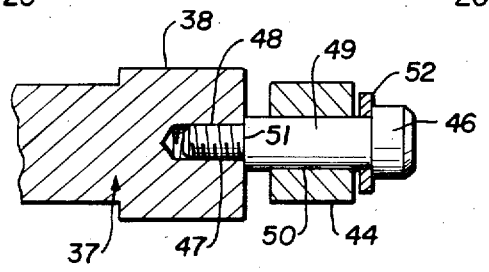
FIG.10

ROCKET EXTRACTION DEVICE

The invention described herein may be manufactured and used by or for the Government for governmental purposes without the payment of any royalties thereon or therefor.

BACKGROUND OF THE INVENTION

The extraction of live rockets from rocket launch tubes in the event that the rockets are unlaunched or their motors misfire presents some unique problems which the present invention seeks to solve, and which have not been successfully dealt with in the known prior art.

For example, some rockets have spider plates attached to the exhaust end of the rocket motor and such plates include a crossbar which is spaced too closely to the adjacent wall of the spider plate to serve effectively as a hand grip. The fingers of personnel attempting to grip the spider plate crossbar will not, in some cases, fit between the bar and adjacent wall. Also, because rockets of the type and size for which this tool is intended to be used weigh about 188 pounds each, then understandably to withdraw such a rocket from the launch tube requires overcoming a significant amount of friction between the rocket and its tube.

As a result of the above and in the absence of any suitable gripping bar, inconvenient, time-consuming and sometimes hazardous procedures are resorted to for extracting rockets from launch tubes. Such hazardous procedures include using a wooden pole or beam to push from the front of a launcher tube to dislodge the rocket, after effecting retraction or deflection of the associated rocket retaining detent components. Another hazard is attempting to dislodge the rocket by undue elevating of the launcher whereby the heavy rocket or rockets suddenly dislodge, falling down onto the unprepared soldier before he can attach a suitable lifting sling. Where the rocket contains live components, these haphazard procedures can be extremely dangerous.

Accordingly, it is the objective of the present invention to provide a simplified, convenient and safe device for use in extracting live rockets from launch tubes with a minimum of physical effort, and preferably while the launch tubes are not elevated.

A further object of the invention is to provide a hand-held and hand-operated device which can engage and grip the crossbar of the spider plate at the exhaust end of the rocket motor in order to extract the rocket with a straight pull along the axis of the rocket.

A further important object of the invention is to provide a rocket extraction device which can be operated with one preferably gloved hand and whose gripping jaws are moved into closed gripping engagement with the crossbar of a rocket spider plate by a simple squeezing or gripping action applied to the device by the hand and fingers.

Still another object of the invention is to provide a rocket extraction device of the above-mentioned type whose pivoted gripping jaws are normally biased open and are closed by the camming action of a finger grip bar of the device with cooperative cam faces provided on extensions of the jaws, the arrangement being such that the greater the pressure applied by the user of the device to the finger grip bar, the stronger will be the gripping action of the jaws of the device on the bar member which the jaws are engaging.

Other objects and advantages of the invention will become apparent to those skilled in the art during the course of the following description.

SUMMARY OF THE INVENTION

The foregoing objectives of the invention are realized by the use of a simplified, sturdy and convenient hand-operated live rocket extraction device in accordance with the present invention. Essentially, the device includes a frame member on which spaced pairs of gripping jaws are pivotally mounted for coordinated operation. The pivoted jaws are resiliently biased to open positions. Extensions of the jaws in each pair have convergent cam faces which are engated slidably by a single cylindrical finger grip bar floatingly held captively on the device. The finger grip bar is in parallel relationship to an opposing bar of the frame member so that the finger grip bar can be grasped with the fingers while the palm of the hand is engaged with the opposing bar of the frame member. When the finger grip bar is released, the jaws return automatically to open positions whereby the device can be quickly separated from the rocket undergoing extraction. The finger grip bar is preferably guided in aligned slotways or grooves formed in the frame end support arm members.

BRIEF DESCRIPTION OF THE DRAWINGS

FIG. 1 is a partly schematic end elevation of a rocket launcher depicting the environment of the present invention.

FIG. 2 is an enlarged fragmentary rear end elevation of the rocket launcher showing several adjacent launch tubes with their detents in holding positions.

FIG. 3 is a fragmentary perspective view showing the rear end of one launch tube and a spider plate carried by the exhaust end of a rocket motor in the tube with the detents released to allow extraction of the rocket by the device which forms the subject matter of the invention.

FIG. 4 is a perspective view of the rocket extraction device according to one embodiment of the invention.

FIG. 8 is a side elevation of a rocket extraction device according to another and preferred embodiment of the invention.

FIG. 9 is a vertical section taken on line 9—9 of FIG. 8.

FIG. 10 is an enlarged fragmentary vertical section taken on line 10—10 of FIG. 9.

DESCRIPTION OF THE PREFERRED EMBODIMENT

Figure 5:
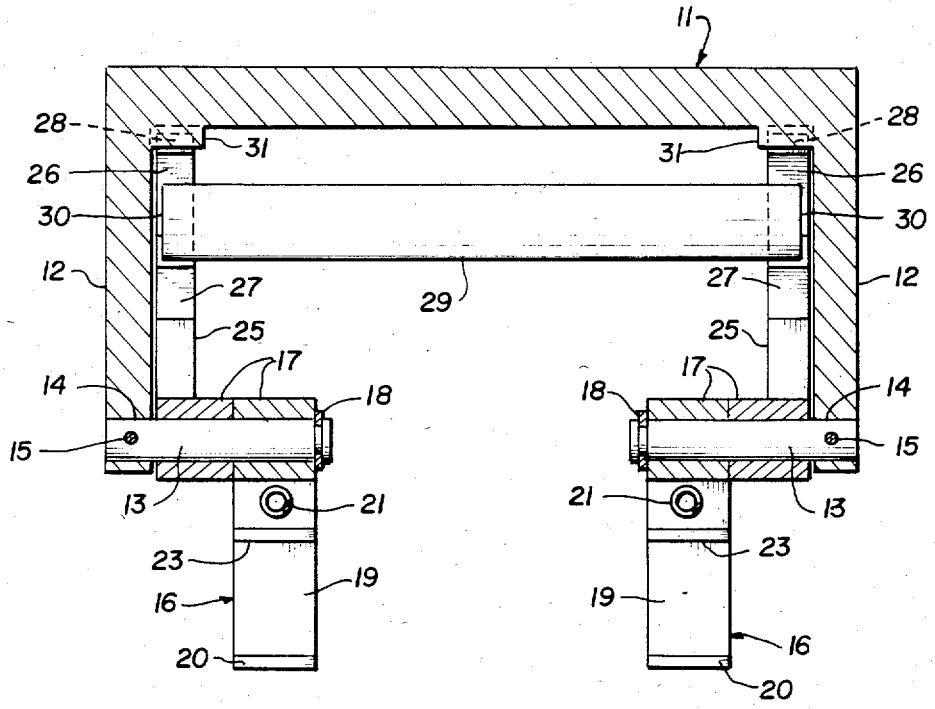
FIG. 5 is a vertical section taken on line 5—5 of FIG. 4.

Referring to the drawings in detail wherein like numerals designate like parts, a live rocket extraction device 10 shown in its entirely in FIG. 4 comprises a rigid frame member including a crossbar 11 and two integral right angular end support arms 12 extending equidistantly beyond one side of the crossbar 11. A pair of spaced coaxial shafts 13 are held in openings 14 of the support arms 12 by roll pins 15, or the like. The two shafts 13 project inwardly of the support arms 12 and have their inner ends 10 spaced apart, as shown.

Pivotally supported on each shaft 13 is a pair of opposing jaws 16 of identical construction, each having a hub portion 17 which is apertured to receive therethrough one of the shafts 13, as best shown in FIG. 5. The hub portions 17 of each pair of jaws 16 are in side-by-side interfitting contacting relationship in the assembled device, as shown in FIGS. 4 and 5. The pairs of jaws 16 are held on the two shafts 13 releasably by lock rings 18 engaged in grooves formed in the shafts near their inner ends.

The jaws 16 of each pair have opposed flat gripping faces 19, provided at their leading ends with short right angular inwardly projecting lips 20. Biasing springs 21 for each pair of jaws are disposed substantially rearwardly of the lips 20 and near and forwardly of the two shafts 13. The ends of the biasing springs 21 are held in retaining recesses 22 formed in the opposing faces of the jaws 16. Rigid spring guards 23 are formed on the jaws 16 substantially rearwardly of the lips 20 to prevent direct contact of the springs with a rocket extraction bar 24 being gripped by the jaws in the use of the device 10.

The jaws 16 of each pair have opposing extension arms 25 formed integral therewith and extending rearwardly toward the crossbar 11 of the frame. The extension arms 25 are offset relative to the gripping jaws toward the support arms 12 of the frame and lie close to these support arms, as shown in the drawings.

The extension arms 25 near their rear ends have flat convergent cam faces 26 and support shoulders 27 extending substantially perpendicular to the cam faces 26. The extension arms 25 also have opposing flat faces 28 at their rear ends beyond the convergent cam faces 26.

A free-floating captively held cylindrical finger grip bar 29 has its opposite end portions received between the convergent cam faces 26 and support shoulders 27. The opposite end faces 30 of the finger grip bar 29, FIG. 5, lie close to the interior sides of the support arms 12 so that the finger grip bar is restrained from appreciable longitudinal displacement. Although no other fastening means are required to retain the finger grip bar 29, because it generally cannot escape from the device after assembly, auxiliary stabilizing means for the finger grip bar will be described relative to a modified embodiment of the invention, and a preferred embodiment, shown in FIGS. 8 to 10 of the drawings.

Figure 6:
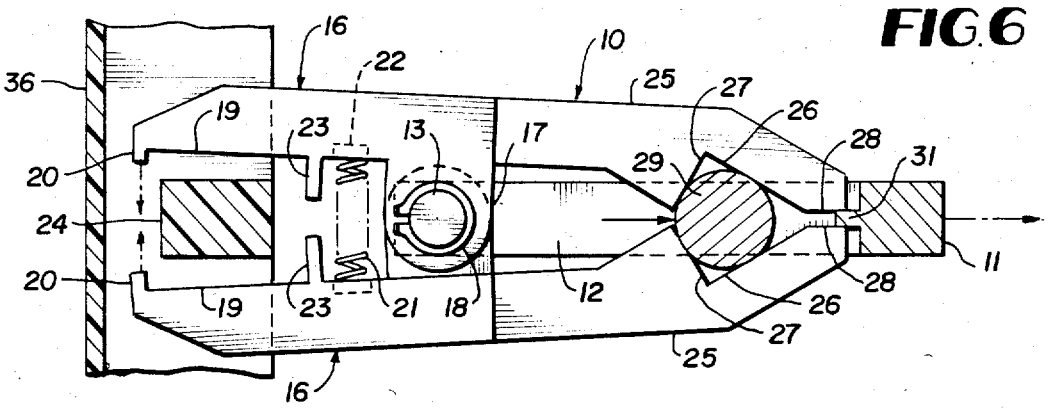
FIG. 6 is a vertical section through the rocket extraction device shown in FIG. 4 in a first position of use.
Figure 7:
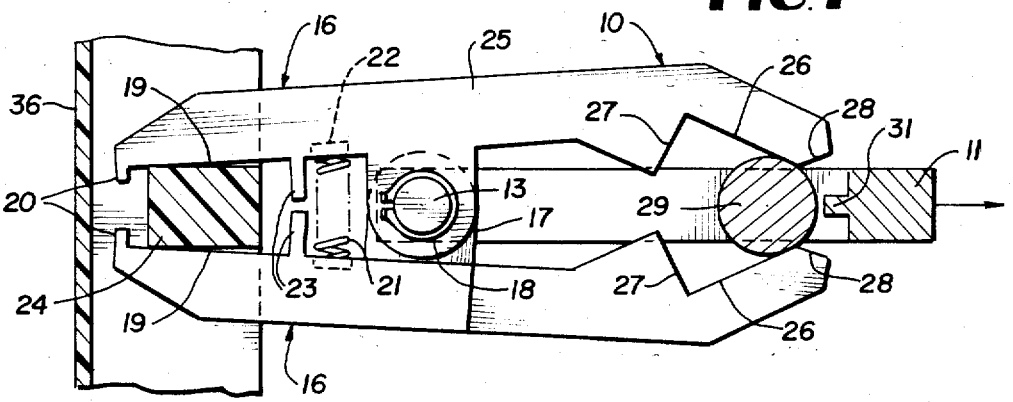
FIG. 7 is a similar view of the device in a second position of use.

A further optional feature of the invention is the provision at each interior corner formed by crossbar 11 and support arms 12 of a fixed rigid centering lug 31. These lugs 31, as shown in FIGS. 6 and 7, are at the transverse center of the crossbar 11 and lie between the flat faces 28 of jaw extension arms 25. Rotation of the two jaw sets on their support shafts 13 in both directions is limited by contact of the flat surfaces 28 with the centering lugs 31, when used. Additionally, the lugs 31 can serve to preclude inadvertent displacement of the hand grip bar due to potential excess cumulative tolerances in the components.

The environment in which the device 10 is used is shown in FIGS. 1 to 3 of the drawings. More particularly, FIG. 1 depicts a rocket launcher 32 containing thirty launch tubes 33. In FIG. 2, several adjacent launch tubes 33 of the launcher 32 are shown in greater detail including spider plates 34 which are attached to the exhaust ends of the rocket motors. In FIG. 2, conventional releasable detents 35 on the launch tubes 33 are actively engaged with the spider plates 34 to prevent extraction of the rockets from the launch tubes. In FIG. 3, the detents 35 are shown in deflected positions away from the spider plate 34 so that a rocket can be extracted from the launch tube 33.

Each spider plate 34 includes a diametrically extending extraction bar 24, referred to previously. Referring to FIGS. 6 and 7, this bar 24 lies relatively close to a flat central web 36 of each spider plate 34. As explained previously, the closeness of the bar 24 to the web 36 makes it difficult or impossible to grasp the bar 24 directly with the fingers and, more particularly, when the hand is encumbered with a protective glove. Therefore, the rocket extraction device 10 fully described above has been provided to engage the bar 24, as depicted in FIG. 3, for extracting a rocket with a straight pull along the axis of the rocket launcher tube applied at the exhaust end of the rocket.

A modified and preferred embodiment of the invention, previously mentioned, is shown in FIGS. 8 through 10 of the drawings. This embodiment differs from the previously-described embodiment in only one respect, and the general construction and mode of operation of the device depicted in FIGS. 8–10 remains unchanged.

In lieu of the described free-floating arrangement of the finger grip bar 29 relative to the frame support arms 12 and jaws 16 in the previous embodiment, a modified finger grip bar 37 is provided in the second embodiment, whose central portion may be somewhat reduced in diameter compared to the finger grip bar 29 to provide increased clearance for gloved fingers. The opposite end terminals 38 of finger grip bar 37, which are somewhat enlarged, engage and cooperate with cam faces 39 and support shoulders 40 of jaw extension arms 41 in the identical manner described for the corresponding elements in the prior embodiment of the invention. The jaw extension arms 41 are carried by cooperative pairs of jaws 42 whose construction and mode of operation in the device is exactly as described in the prior embodiment of the invention.

A rigid frame including a crossbar 43 and right angular support arms 44 is provided, and the support arms 44 are connected by coaxial pivot shafts 45 to the pairs of jaws 42 in the exact manner described for the prior embodiment. The details of the arrangement need not be repeated. The same reference numerals employed in the description of the previous embodiment of the invention are used in the modified embodiment of FIGS. 8 through 10 to identify elements which are not specifically described in connection with the modified embodiment.

In the modified embodiment, FIGS. 8 through 10, the finger grip bar 37 is more positively guided with relation to the frame support arms 44 by a pair of guide screws 46 whose threaded shanks 47 engage within threaded openings 48 formed in the end faces of the finger grip bar 37. Cylindrical enlarged shank portions 49 of the screws 46 are received guidingly in straight slots 50 formed longitudinally in the arms 44. Square shoulders 51 of shank portions 49 solidly abut the end faces of the finger grip bar 37, FIG. 10, and flat washers 52 may be interposed between the heads of screws 46 and arms 44, as shown. The previously-described lugs 31 of the previous embodiment are not essential in the preferred embodiment of FIGS. 8 to 10 and can be omitted.

The described positive guidance of the finger grip bar 37 limits rotation of the jaws 42 on their pivot shafts 45 in both directions, and also precludes separation of the finger grip bar from the device under any and all conditions of dimensional tolerance build up.

The use of the rocket extraction device constructed in accordance with either described embodiment of the invention should now be readily apparent to those skilled in the art. The device is held by a user in one hand, and when no gripping pressure is applied to the finger grip bar 29 or 37 to draw it toward the frame crossbar 11 or 43, the compression springs 21 will maintain the jaws 16 or 42 separated as shown in FIG. 6 so that the lips 20 and jaw faces 19 may properly engage the extraction bar 24.

Following this, the finger grip bar is pulled by the fingers in a squeezing mode toward the frame crossbar 11 or 43 and this causes the finger grip bar to react with the cam faces 26 or 39 and spread apart the extension arms 25 or 41, thereby simultaneously closing the pairs of jaws 16 or 42 on the rocket extraction bar 24, as shown in FIG. 7.

A straight pull on the extraction bar 24 by means of the device according to the invention while the rocket launcher 32 is substantially level will cleanly extract each rocket from its launcher tube 33 with minimal effort and comparative safety. The positive engagement lips 20 of the jaws through their engagement with the extraction bar 24 prevents slippage of the device during the extraction process. Increased pulling pressure on the finger grip bar 29 or 37 through cam action tightens the grip of the pivoted jaws on the rocket extraction bar 24.

When the rocket is extracted sufficiently from its launcher tube to permit handling without use of the device according to the invention, pressure on the finger grip bar 29 or 37 is relieved and the jaws of the device automatically open under pressure from the springs 21, allowing complete separation of the device from the extraction bar 24. The completion of the rocket extraction from its launcher tube is then carried out without further use of the invention.

The device is safe, rugged and durable, convenient to use and compact. Its component parts are retained in assembled relationship by means of the two lock rings 18 and two roll pins 15. The device is essentially foolproof and very efficient. It greatly reduces the hazard involved in extracting rockets with live components by previous haphazard means.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A rocket extraction device adapted to be held and operated by one hand of a user comprising a supporting frame including a crossbar, spaced coaxial shafts on said frame and being in spaced parallel relationship to the crossbar, pairs of opposing jaws pivotally held on said shafts with the pairs in spaced relationship, extension arms on the jaws and projecting therefrom toward said crossbar and having opposing cam faces and support shoulders adjacent to the cam faces, a finger grip bar movably disposed between said extension arms and being engageable with said cam faces and support shoulders and having end faces in opposing relationship to parts of said frame, and resilient means biasing said jaws toward separated positions, movement of the finger grip bar toward said crossbar causing closing of said jaws by camming action of the finger grip bar on said cam faces.

2. A rocket extraction device as defined in claim 1, and said supporting frame further including spaced parallel support arms at the ends of said crossbar extending beyond one side of the crossbar substantially at right angles thereto, said coaxial shafts being secured to said support arms, and said extension arms and the opposite end faces of the finger grip bar being arranged near the interior faces of said support arms, and means on said supporting frame to maintain said jaws generally centered rotationally with respect to the supporting frame.

3. A rocket extraction device as defined in claim 2, and said last-named means comprising a pair of guide slots in said support arms, and a pair of coaxial finger grip bar guide elements anchored to the opposite ends of the finger grip bar and being guidingly engaged within said guide slots.

4. A rocket extraction device as defined in claim 3, and said guide elements comprising screws threadedly engaged within threaded openings in the opposite ends of the finger grip bar and having cylindrical shank portions engaged within said guide slots.

5. A rocket extraction device as defined in claim 2, and said last-named means comprising a pair of lugs on the supporting frame at the two interior corners thereof defined by said crossbar and support arms, and said lugs being disposed between end portions of said extension arms.

6. A rocket extraction device as defined in claim 1, and said finger grip bar comprising a straight cylindrical bar.

7. A rocket extraction device as defined in claim 1, and said jaws having opposing substantially flat gripping faces, and rigid lips secured to the ends of said jaws and projecting inwardly of said gripping faces whereby the jaws are adapted to positively engage and pull a rectangular cross section rocket extraction bar.

8. A rocket extraction device as defined in claim 2, and said jaws being offset inwardly of said extension arms and away from said support arms, and the jaws of said pairs having interfitting apertured hub portions receiving said coaxial shafts.

9. A rocket extraction device as defined in claim 8, and releasable lock rings on said shafts near their interior ends and maintaining said jaws in assembled relationship with said supporting frame.

10. A hand-held rocket extraction device adapted to be engageable with an extraction bar on the exhaust end of a rocket disposed within a rocket launch tube, said device comprising a U-frame adapted to serve as a handle, a pair of spaced coaxial shafts on opposite sides of the U-frame and projecting inwardly from such sides, pairs of opposing jaws having longitudinal extension arms pivotally held on said shafts with the pairs of jaws in spaced relationship, said jaw extension arms having convergent cam faces and support shoulders adjacent to said cam faces and being generally perpendicular thereto, a finger grip bar having cylindrical end portions which are engaged movably in spaces defined by said cam faces and support shoulders, the opposite end faces of the finger grip bar being disposed near the interior faces of the sides of said U-frame and in opposing relationship therewith, means biasing the opposing jaws of said pairs toward separated positions, and finger grip bar guidance and jaw pair centering means on said U-frame.

11. A hand-held rocket extraction device as defined in claim 10, and said last-named means comprising guidance slots in the sides of said U-frame, and finger grip bar guidance elements within said slots and fixed to the ends of the finger grip bar.

12. A hand-held rocket extraction device as defined in claim 10, and the opposing jaws of said pairs having substantially flat opposing gripping faces and substantially right angular opposing lips at their forward ends, whereby the jaws are adapted to grip and pull a rectangular cross section rocket extraction bar while in closed gripping relationship responsive to movement of the finger grip bar toward the handle portion of said U-frame.

13. A hand-held rocket extraction device as defined in claim 10, and said resilient means comprising compression springs disposed between the jaws of the pairs, and rigid spring guards on the jaws of the pairs projecting inwardly thereof and located between said springs and the leading ends of the jaws to preclude engagement of the springs with a rocket extraction bar being gripped by the jaws of the pairs.

14. A rocket extraction device comprising a U-frame including a crossbar and spaced side support arms, coaxial shafts on the support arm, pivoted jaw pairs on said shafts and being disposed interiorly of the support arms and having cam faces formed thereon between said support arms, said jaws having rocket extraction bar gripping portions extending beyond corresponding sides of said shafts and beyond the ends of the support arms defining an open side of said U-frame, a separate, elongated finger grip bar disposed movably within said U-frame and extending between the support arms thereof in parallel relationship to said crossbar and being engageable with said cam faces, and spring means connected with the jaws of said pairs and biasing them toward separated positions.

* * * * *